US006164616A

United States Patent [19]

Woods et al.

[11] Patent Number: 6,164,616

[45] Date of Patent: Dec. 26, 2000

[54] FRUIT HANGING DISPLAY STAND

[75] Inventors: Laura J. Woods, 11246 Lewistown St., Commerce City, Colo. 80022; James W. Schreiber; Davey B. Palmer, both of Littleton, Colo.

[73] Assignee: Laura J. Woods, Commerce City, Colo.

[21] Appl. No.: 09/338,713

[22] Filed: Jun. 23, 1999

[51] Int. Cl.[7] ..... F16M 11/00

[52] U.S. Cl. ..... 248/686; 248/122.1

[58] Field of Search ..... 248/686, 122.1, 248/128, 346.01, 318

[56] References Cited

U.S. PATENT DOCUMENTS

| | | | |
|---|---|---|---|
| D. 290,200 | 6/1987 | Tabach | D6/462 |
| D. 290,558 | 6/1987 | Zorrilla | D6/462 |
| D. 300,790 | 4/1989 | Beckwith | D6/462 |
| D. 335,401 | 5/1993 | Nations | D6/462 |
| D. 361,472 | 8/1995 | Heilicher | D7/505 |
| D. 365,249 | 12/1995 | Reisman | D7/602 |
| D. 385,751 | 11/1997 | Hollinger | D7/601 |
| 873,881 | 12/1907 | Molony . | |
| 977,071 | 11/1910 | Crandall . | |
| 1,078,804 | 11/1913 | Royse . | |
| 1,554,789 | 9/1925 | Crary | 248/346.01 X |
| 1,658,456 | 2/1928 | Meyer | 248/346.01 |
| 1,754,998 | 4/1930 | Geartts . | |
| 2,040,004 | 5/1936 | Kelsay . | |
| 2,066,478 | 1/1937 | Lewin . | |
| 2,207,731 | 7/1940 | Hagopian . | |
| 3,009,599 | 11/1961 | Schier et al. . | |
| 3,139,209 | 6/1964 | Wise . | |
| 3,756,462 | 9/1973 | Cain . | |
| 5,271,508 | 12/1993 | Gamwell | 209/682 |
| 5,992,624 | 11/1999 | Hodson | 248/318 X |

*Primary Examiner*—Ramon O. Ramirez
*Attorney, Agent, or Firm*—Sheridan Ross P.C.

[57] ABSTRACT

A portable, hanging fruit stand is provided which conveniently stores fruit at a variety of heights without damaging the fruit and allowing water to drain from the fruit and be collected in a catch basin.

18 Claims, 4 Drawing Sheets

FRUIT HANGING DISPLAY STAND

FIELD OF THE INVENTION

The present invention relates to a fruit display method and apparatus and in particular to a hanging display stand which catches fallen fruit and drains away excess water.

BACKGROUND OF THE INVENTION

Fruits and vegetables have increasingly been proven to be vital staples of a healthy diet. However prior to eating the fruit it is imperative that the fruit is properly washed to assure that any foreign materials including residue from pesticides be removed. After washing the fruit should be thoroughly dried.

Unfortunately, there are no convenient and practical fruit hanging display stands, especially for grapes which allow for the drying of the fruit yet providing a catch basis for the dripping water. Further there is a need for a fruit hanging stand which hangs the fruit in a manner which is aesthetically pleasing, does not damage the fruit, and which efficiently optimizes space to hang the maximum amount of fruit in a confined space.

SUMMARY OF THE INVENTION

It is thus an object of the present invention to provide a fruit hanging stand which is capable of holding fruit in a minimum amount of space while collecting dripping water in a catch basins, yet keeping the fruit elevated above the water. It is a further object that the display stand functionally holds fruit at a variety of different levels to accommodate different sizes of bundles of fruit, and that the fruit can be quickly attached and detached from the stand. It is yet another object that the fruit stand is capable of being manufactured using traditional manufacturing techniques in a cost effective manner.

DETAILED DESCRIPTION OF THE PREFERRED EMBODIMENTS

The invention relates to a fruit hanging display stand which allows draining away any liquids remaining after washing the fruit. If any of the fruit falls from the stem or vine, a bowl is positioned to receive this fruit. As can be appreciated, any liquids which have dripped off the fruit should be drained away from the fruit to inhibit spoilage. Since the fruit may have a number of different shapes, an extension arm and fruit retention member, which holds the fruit, should have an adjustable vertical height and horizontal length. Although many types of fruit may use the invention, the discussion is primarily in the context of bundles of grapes.

Grape bundles vary in size from a very small single stem with fine off shoot secondary stems where the overall bundle size might be as small as 2 inches tall by 2 inches around to much larger bundles with 10 inch long main stems and a bundle that is 6 or more inches around. Irregular bundles are easily found that can be 5 inches tall and 7 or more inches around. Grapes ripen rather quickly and so grapes tend to fall off the bundle with little disturbance. Grapes usually come fresh with a main stem cut off one to 2½ inches above the main bundle. However, this is not always the case.

In order to store large bundles next to each other the wide bulk of the large bundle should not be positioned immediately adjacent to another bundle's major girth. If the storage position of one bundle is above or below the adjacent bundle such that the main girth of each bundle is separated by a satisfactory height, the bundles can be easily stored very close to each other.

Figure 1:
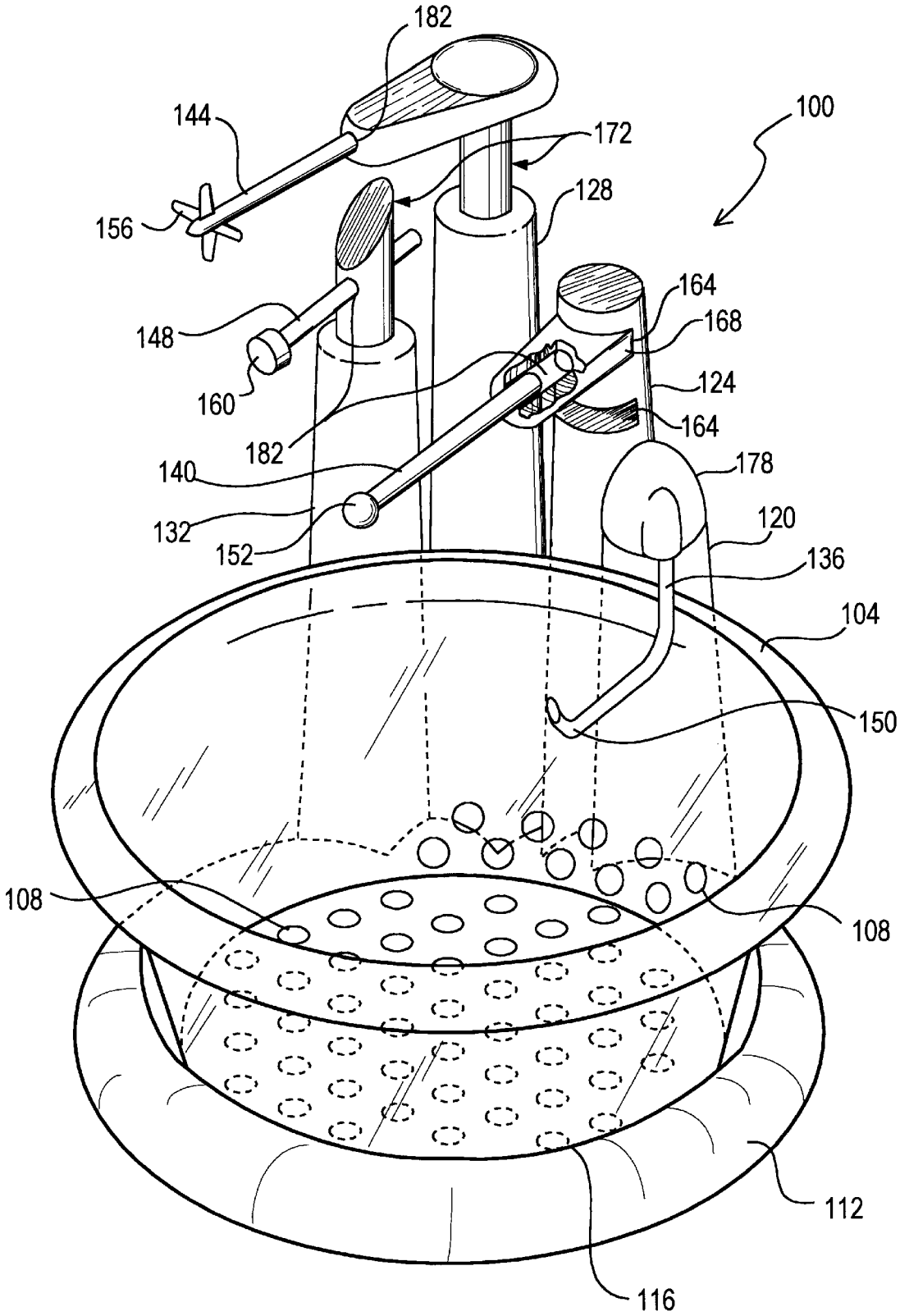
FIG. 1 is a perspective view of an embodiment of a grape hanging display stand with a removable bowl and multiple posts.

With reference to FIG. 1, a perspective view of an embodiment of a grape hanging display stand 100, with a removable bowl 104 and multiple posts 120, 124, 128, 132, is schematically shown. The display stand 100 includes the bowl 104, a base 112, a bowl retainer 116, four posts 120, 124, 128, 132, and four extension arms 136, 140, 144, 148. Each extension arm 136, 140, 144, 148 has a corresponding fruit retention member 150, 152, 20 156, 160. Each of the posts 120, 124, 128, 132 and their corresponding extension arms 136, 140, 144, 148 have different configurations to illustrate various possibilities. It is to be understood, however, other embodiments could have all posts and extension arms be the same configuration.

The base 112 provides balance to the posts 120, 124,128, 132 and positioning for the bowl 104. The base 112 may be molded integrally to the posts 120, 124, 128, 132 or otherwise affixed to the posts 120, 124, 128, 132. Additional weight, for example from sand, may be added to the base 112 in order to enhance stability. An annular recess or bowl retainer 116 is generally shaped as the conjugate of the bowl 104 and holds the bowl 104 in place. In other embodiments, the base 112 could further include a catch basin or drip pan to catch any liquid which precipitates from the drying grapes.

The bowl 104 is positioned beneath any hanging grapes, serves to catch any fallen grapes and allows for convenient washing of the grapes. The bowl has perforations 108 which are sized to allow water to pass through, but prevent grapes from falling through. Additionally, the bowl 104 is removable from the bowl retainer 116. To wash the grapes, they are placed in the bowl 104, the bowl 104 is removed from the bowl retainer 116, and water is poured over the grapes. Once the grapes have partially dried, they are transported back to the display stand 100 in the bowl 104, whereupon, the grape bundles are separated and hung from the extension arms 136, 140, 144, 148. Any excess water from the drying grapes will fall through the perforations 108 in the bowl 104. Accordingly, any fallen grapes will not rest in this excess water.

Posts 120, 124, 128, 132 have an adjustable vertical height to suspend the grapes above the bowl 104. The second post 124 has a number of notches or cutouts 164 which mate to a conjugate member 168. Friction or other methods can be used to removably mate the conjugate member 168 to any of the notches 164. Adjusting the suspension height of the grape bundle is achieved by choosing the appropriate notch 164 to insert the conjugate member 168. The third and fourth posts 128, 132 each have a piston member 172 which is vertically adjustable. The piston member 172 is partially enclosed in the post 128, 132 and friction or other methods can be used to affix the piston member 172 at a desired extension from the post 128, 132. The first post 120 allows an end cap 178 to radially pivot about an axis defined by the first post 120 and, additionally, allows the extension arm 136 to radially pivot about an axis near a circumferential position of the end cap 178. The third and fourth posts 128, 132 allow their corresponding extension arms 144, 148 to radially pivot about an axis defined by their respective posts 128, 132. By adjusting the vertical height and radial position at which the grape bundles are hung, the widely varying shapes of grape bundles are accommodated. In this embodiment, the posts are 11 to 13 inches tall and the distance between the extension arm 136, 140, 144, 148 and bowl 104 is about 10 inches (maximum).

The extension arm 136, 140, 144, 148 suspends the grape bundles away from the posts 120, 124, 128, 132 and over the bowl 104. An apex of an inverted v-shaped area between branches of the grape bundle rests on the extension arm 136, 140, 144, 148. To accommodate grape bundles of different widths, the horizontal length of the extension arm 136, 140, 144, 148 adjusts away from the post. The first post 120 allows the end cap 178 and extension arm 136 to pivot for a variable horizontal length. The second, third and fourth posts 124, 128, 132 allow their respective extension arms 140, 144, 148 to slide within a tube 182 to different horizontal lengths. The conjugate member 168 of the second post 124 is partially cut away to reveal the tube 182 through which the extension arm 140 slides. Without any grape bundles on the extension arm 140, 144, 148, the extension arm slides freely through the tube 182. However, once downward force is applied to the horizontal length of the extension arm 140, 144, 148 by an incident grape bundle, the extension arm 140, 144, 148 remains fixed with respect to the tube 182. Although the extension arms 136, 140, 144, 148 are shown perpendicular to the posts 120, 124, 128, 132, other embodiments could have the extension arms 136,140, 144,148 inclined toward the bowl 104. The incline would allow any grape bundles placed on the extension arms 136, 140, 144, 148 to slide distally toward the fruit retention member 150, 152, 156, 160. In this embodiment, the extension arms 136, 140, 144, 148 are from 0.125 through 0.375 in diameter and adjust to have a horizontal extension from the post 120, 124, 128, 132 of 1 through 4 inches.

The fruit retention member 150, 152, 156, 160 keeps the grape bundle on the extension arm 136, 140, 144, 148. The retention member 150 on the first post 120 is hook shaped, but the retention members 152, 156, 160 on the second through fourth posts 124, 128, 132 are a variety of bulbous shapes. The second through fourth retention members 152, 156, 160 are sized to be both small enough to fit between two grape branches and large enough to prevent the grape bundle from slipping off the extension arm 140, 144, 148. In this embodiment, the bulbous ends of the retention members 152, 156, 160 generally have a diameter of 0.313 through 0.500 inches.

Figure 2:
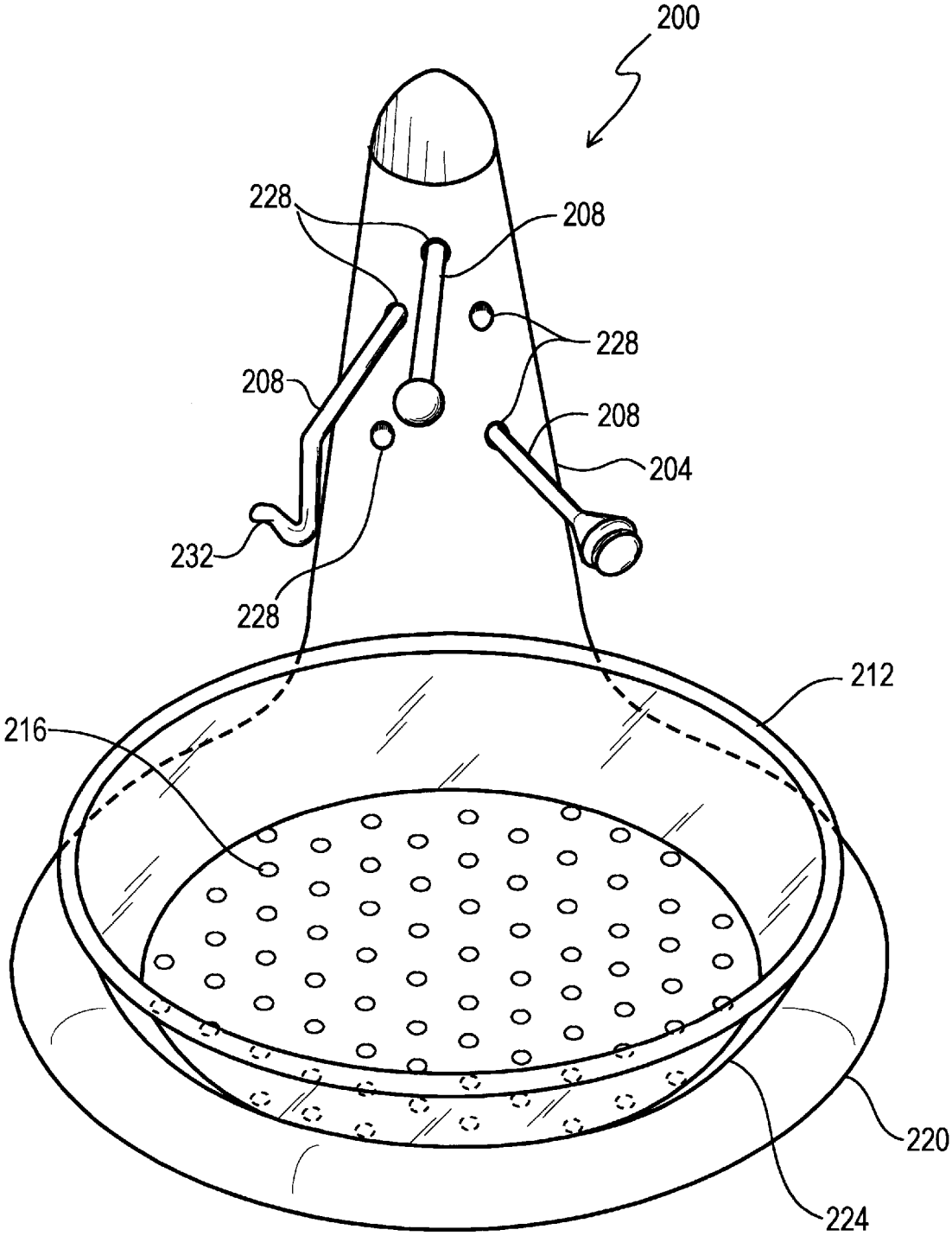
FIG. 2 is a perspective view of an embodiment of a grape hanging display stand with a single post having multiple extension arms and a removable bowl having perforations.

With reference to FIG. 2, shown is a perspective view of an embodiment of a grape hanging display stand 200, with a single post 204 having multiple extension arms 208 and a removable bowl 212 having perforations 216. The bowl 212 is removable to ease washing of the grape bundles. An annular recess or bowl retainer 224, integral to a base 220, aids in positioning the bowl 212. The post 204 has a number of tubes 228 therethrough which accommodate the extension arms 208. The tubes 228 are formed along different radial positions such that multiple grape bundles tend not interfere with each other. To adjust the horizontal length of the extension arms 208, they can slide within the tubes 228. There are many tubes 228 along the post such that extension arms 208 may be placed at a desired vertical height. This embodiment includes a fruit retention member 232 which is hook-shaped. The other retention members are generally bulbous shaped.

Figure 3:
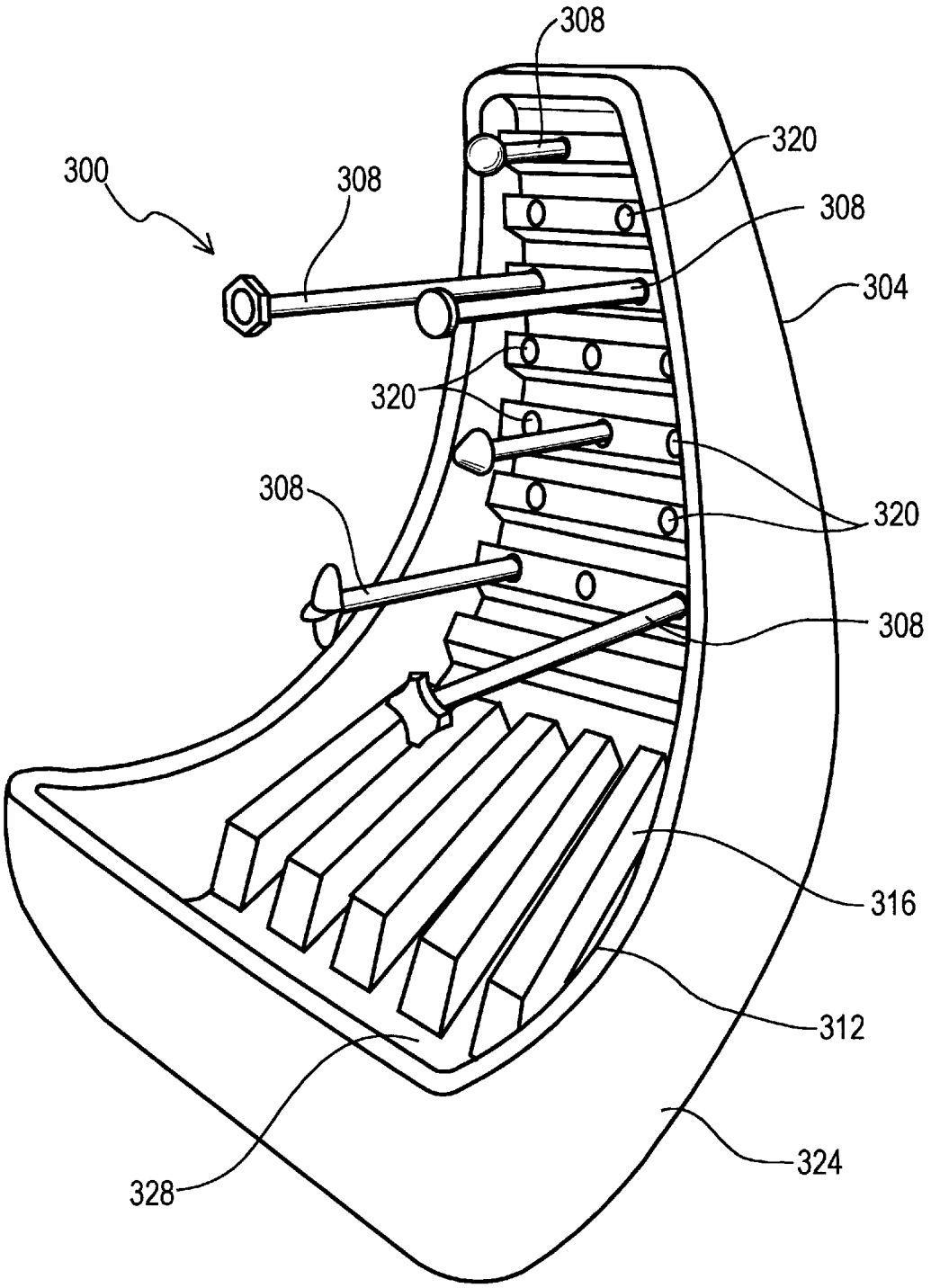
FIG. 3 is a perspective view of an embodiment of a grape hanging display stand with a single post having multiple extension arms and an integral bowl having a number of elongated ridges.

Referring to FIG. 3, a perspective view of an embodiment of a grape hanging display stand 300, with a single post 304 having multiple extension arms 308 and an integral bowl 312 having a number of elongated ridges 316, is schematically illustrated. The bowl 312 is integral to a base 324. The elongated ridges 316 in the bowl 312 allow sluicing away water from any fallen grapes. The elongated ridges 316 are spaced so that the fallen grapes do not contact a bottom 328 of the bowl 312 where there may be standing water. Tubes 320 formed in the post 304 extend generally perpendicular to the post 304 and are not configured at different radial positions. To accommodate multiple bundles, the tubes 320 are horizontally offset on the wide post 304, and the post 304 is tall enough to allow stacking of grape bundles. The horizontal extension of the extension arms 308 away from the post 304 is adjustable.

Figure 4:
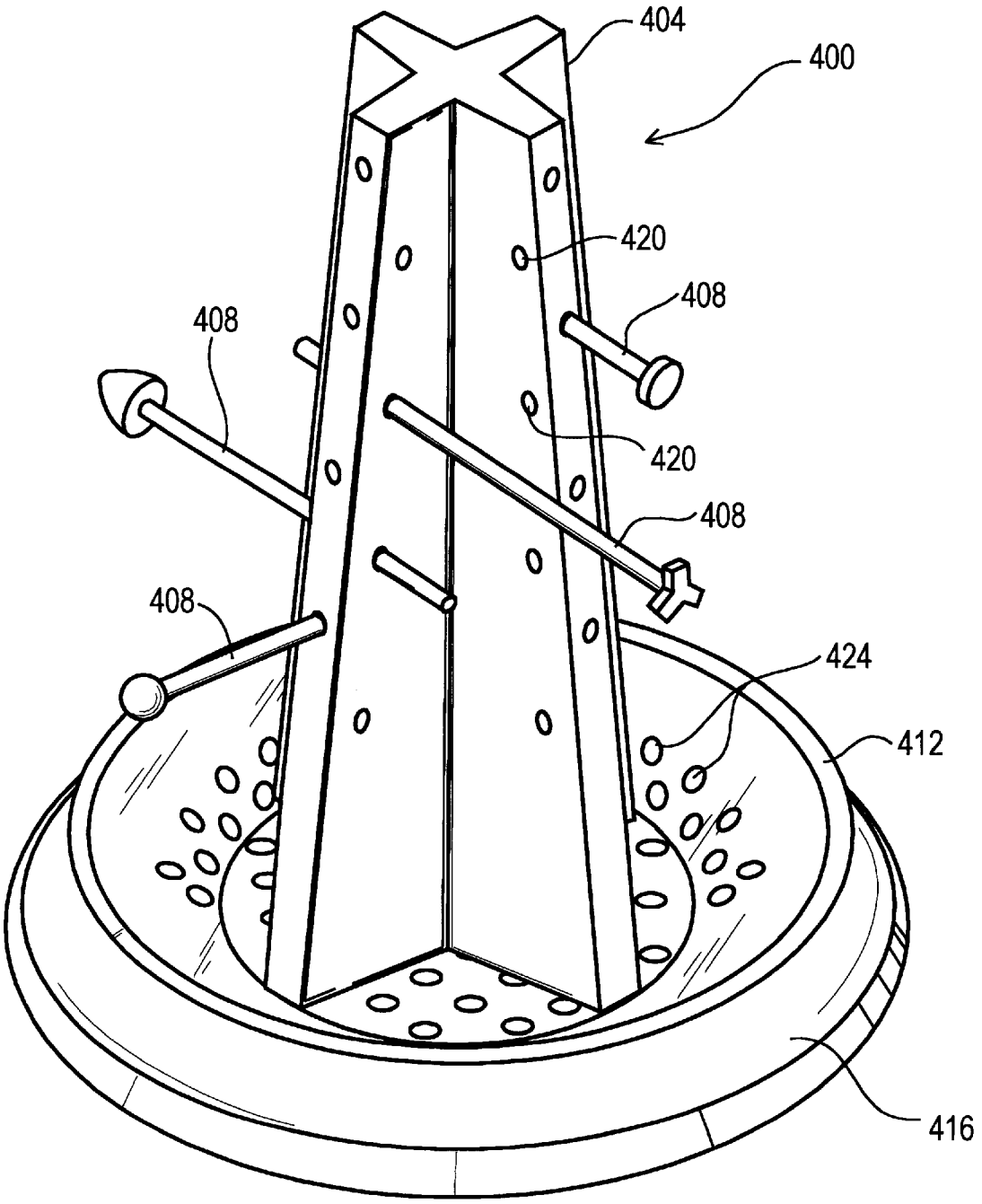
FIG. 4 is a perspective view of an embodiment of a grape hanging display stand with a single post having multiple extension arms.

Referring to FIG. 4, a perspective view of an embodiment of a grape hanging display stand 400, with a centrally positioned post 404 having multiple extension arms 408, is schematically depicted. The post 404 from a top view or top cross-section is cross shaped. This shape allows placing the extension arms 408 at a number of locations around the periphery of the post 404. The extension arms 408 can be placed perpendicular or tangentially to the post, as shown in FIG. 4. A bowl 412 is placed atop a base 416. Although not visible in the drawing, the base 416 may contain a concave depression beneath a bowl 412 which serves as a catch basin for any water run-off. The bowl 412 has a number of perforations 424 to allow draining water away from any grapes and into the catch basin. Additionally, the post 404 could removably attach to the base 416 with vertical pegs attached to the post 404 which pass through the perforations 424 and mate to holes in the base 416.

Fruit Retention Members: In some embodiments, the fruit retention members can be 'J' shaped or a flat 'S' shaped. The short leg of the 'J' which holds the grapes should be from 1 to 3 inches long. The long leg of the 'J' hook would be pressed into a tube in the post or otherwise attached to the post to secure it in place. One leg of the 'S' hook would be designed to mate with the post so that it stays in place or is moveable depending upon the design. The other leg of the 'S' hook should extend from 1 to 3 inches in order to hang the various sizes of grape bundles.

An alternative for the fruit retention members is round, oval, square, or rectangular extension arm with a bulbous or spherical end. The extension arm should extend from the post so that the bulbous or spherical end, which catches the grape bundle, is from 1 to 4 inches from a post surface.

Bowl: Storage of the grape bundles in a circular manner around a circular bowl, tray, or catch basin is preferred, since this configuration takes up minimal counter top space. The purpose of the bowl is to catch fallen grapes and droplets of rinse water. The bowl can be integral to the post.

Catch Basin: A catch basin could be used to store waste water for disposal at a later time. The catch basin could be a slide-in tray that allows the user to dispose of waste water.

Manufacture: Each of the components could be connected into a single plastic molded unit. The materials of the components could include plastic, wood and/or metal. If significant production volume is achieved, plastic may be the material of choice. If low production volumes are the norm, wood may be the best material.

A number of additional variations and modifications of the invention can also be used. The extension arms could be bendable such that any desired shape could be achieved by deforming the extension arms. Further, the extension arms could be removable from the posts or integral to the posts. Integral extension arms would not risk being lost. Additionally, the fruit retention member could be a clip at the distal end of the extension arm. The clip could retain the fruit by a stem. Further still, a catch basin could be part of the base beneath the bowl to retain any excess water run-off. The catch basin could be removable in order to easily dispose of any water. Even though some of the extension arms are generally bulbous, other embodiments could remove the bottom portion and still adequately retain the grape bundle.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and\or reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A fruit hanger for drying and displaying fruit, comprising:

a base;

a post interconnected to the base;

an extension arm interconnected to the post;

a fruit retention member rigidly interconnected to a distal end of the extension arm; and a bowl having a drain which allows water to pass and prevents fruit from passing, wherein the bowl is interconnected to the base.

2. The fruit hanger for drying and displaying fruit of claim 1, wherein said fruit retention member is integral to said extension arm.

3. The fruit hanger for drying and displaying fruit of claim 1, wherein a horizontal length of the extension arm adjusts.

4. The fruit hanger for drying and displaying fruit of claim 1, wherein a vertical height of the extension arm adjusts.

5. The fruit hanger for drying and displaying fruit of claim 1, wherein the drain includes a plurality of perforations.

6. The fruit hanger for drying and displaying fruit of claim 1, wherein the extension arm pivots radially.

7. The fruit hanger for drying and displaying fruit of claim 1, further including a plurality of posts.

8. The fruit hanger for drying and displaying fruit of claim 1, further including a plurality of extension arms.

9. The fruit hanger for drying and displaying fruit of claim 1, wherein the extension arm is deformable.

10. The fruit hanger for drying and displaying fruit of claim 1, wherein the bowl is removable from the base.

11. The fruit hanger for drying and displaying fruit of claim 1, wherein the bowl includes a plurality of elongated ridges.

12. A fruit hanger for drying and displaying fruit, comprising:

a base;

a post interconnected to the base;

an extension arm interconnected to the post; and a bowl having a drain which allows water to pass and prevents fruit from passing, wherein the bowl is interconnected to the base, and wherein an angle between the extension arm and the post is less than 90°.

13. A method for hanging fruit on a display stand, comprising the steps of:

providing an extension arm;

providing a fruit retention member rigidly interconnected to said extension arm;

adjusting a vertical height of said extension arm;

adjusting a horizontal length of said extension arm;

passing the fruit over said fruit retention member; and resting the fruit on said extension arm.

14. The method for hanging fruit on a display stand of claim 13, further comprising the steps of:

providing a bowl; and draining liquid from said bowl.

15. The method for hanging fruit on a display stand of claim 13, further comprising the step of retaining fallen fruit in a bowl beneath the extension arm.

16. The method for hanging fruit on a display stand of claim 15, wherein the fallen fruit in the bowl is kept away from any drained liquid.

17. The method for hanging fruit on a display stand of claim 13, wherein the resting step includes resting an inverted v-shaped portion of the fruit so that an apex of the inverted v-shape is on top of the extension arm.

18. The method for hanging fruit on a display stand of claim 13, wherein said fruit retention member is integral to said extension arm.

* * * * *